US007214426B2

(12) United States Patent
Schütze et al.

(10) Patent No.: US 7,214,426 B2
(45) **Date of Patent: *May 8, 2007**

(54) PRODUCTION OF POLYPROPYLENE FINE MONOFILAMENTS, POLYPROPYLENE FINE MONOFILAMENTS AND USE THEREOF

(75) Inventors: Gustav Schütze, Trin (CH); Max Kurt, Rothenburg (CH)

(73) Assignee: Rhodia Industrial Yarns AG, Emmenbrucke (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/961,199

(22) Filed: Oct. 12, 2004

(65) Prior Publication Data

US 2005/0129940 A1 Jun. 16, 2005

Related U.S. Application Data

(63) Continuation of application No. 10/475,611, filed as application No. PCT/CH02/00171 on Mar. 22, 2002, now Pat. No. 6,805,955.

(30) Foreign Application Priority Data

Apr. 24, 2001 (CH) ..... 747/01

(51) Int. Cl.
*D01F 6/00* (2006.01)
*B32B 9/00* (2006.01)
*D03D 23/00* (2006.01)

(52) U.S. Cl. ..... 428/364; 428/394; 139/383 R

(58) Field of Classification Search ..... 428/364, 428/394, 372; 520/116, 351; 524/451, 449; 139/383 R See application file for complete search history.

(56) References Cited

U.S. PATENT DOCUMENTS 3,884,894 A 5/1975 Amass et al.
3,969,313 A * 7/1976 Aishima et al. ..... 523/202

(Continued)

FOREIGN PATENT DOCUMENTS

DE 12 23 150 B 8/1966

(Continued)

*Primary Examiner*—N. Edwards
(74) *Attorney, Agent, or Firm*—Buchanan, Ingersoll & Rooney PC

(57) ABSTRACT

In a process for producing fine monofilaments having improved abrasion resistance from a polypropylene having a melt flow index $(MFI)_{230°\ C./2.16\ kg}$ of 2–16 g/10 min at a linear density of 5–20 dtex (0.027 mm–0.053 mm), a compound consisting of 80 to 99.9% by weight of chips and 20 to 0.1% by weight of an additive is added to the extruder, the melt is spun at a speed of at least 1200 m/min, the fibre is cooled in an air bath at room temperature, supplementarily stretched at a temperature of 110–150° C. to a linear density of 5–20 dtex and wound up.

The monofilaments comprising a polypropylene having a melt flow index $(MFI)_{230°\ C./2.16\ kg}$ of 2–16 g/10 min, having improved abrasion resistance, and a linear density of 5–20 dtex (0.027 mm–0.053 mm) and an abrasion resistance score ≦2. The monofilaments have a tenacity of at least 48 cN/tex and an elongation at break of less than 45% for a mechanical constant (constante méchanique) of at least 295 cN/tex and a specific work to break value of more than 61.5 cN·cm/dtex.

The fine monofilaments according to the invention are useful for producing woven screen fabrics for filtration and screen printing without abrasion deposits.

12 Claims, 3 Drawing Sheets

U.S. PATENT DOCUMENTS

| | | | | | |
|---|---|---|---|---|---|
| 3,994,258 | A | * | 11/1976 | Simm | 118/626 |
| 4,536,361 | A | * | 8/1985 | Torobin | 264/167 |
| 5,082,888 | A | | 1/1992 | Abe et al. | |
| 5,576,366 | A | * | 11/1996 | Sheth | 524/140 |
| 6,127,480 | A | * | 10/2000 | Dominguez et al. | 525/74 |
| 6,833,333 | B2 | * | 12/2004 | Reisdorf et al. | 442/64 |
| 6,858,057 | B2 | * | 2/2005 | Healey | 55/528 |

FOREIGN PATENT DOCUMENTS

| | | | |
|---|---|---|---|
| DE | 198 19 682 | A | 11/1999 |
| EP | 0028844 | A | 5/1981 |
| EP | 0670349 | A | 9/1995 |
| EP | 1059370 | A | 12/2000 |
| JP | 61-097416 | A | 5/1986 |

* cited by examiner

PRODUCTION OF POLYPROPYLENE FINE MONOFILAMENTS, POLYPROPYLENE FINE MONOFILAMENTS AND USE THEREOF

CROSS REFERENCE TO RELATED APPLICATIONS

This application is a continuation of U.S. application Ser. No. 10/475,611, filed on Mar. 15, 2004 now U.S. Pat. No. 6,805,955, which in turn is a §371 of PCT/CH02/00171, filed on Mar. 22, 2002, which published as WO 02/086207 on Oct. 31, 2002, in German, which in turn claims priority to Swiss Patent Application No. CH 747/01, filed Apr. 24, 2001. All of these applications are hereby incorporated in their entirety.

BACKGROUND OF THE INVENTION

1. Field of the Invention

The invention relates to a process for producing fine monofilaments having improved abrasion resistance from polypropylene having a melt flow index $(MFI)_{230° C./2.16 kg}$ of 2–16 g/10 min, to a monofilament of polypropylene having a melt flow index $(MFI)_{230° C./2.16 kg}$ of 2–16 g/10 min having improved abrasion resistance and a linear density of 5–20 dtex (0.027 mm–0.053 mm) and also to the use thereof.

2. Description of Related Art

Industrial fabrics composed of polypropylene are becoming of increased interest in the automotive industry, in particular because they are lighter and more stable to environmental effects and mechanical stress than other thermoplastic materials. There is a particular demand for fine monofilaments, which permit a further weight reduction. By fine monofilaments are meant monofilaments having a linear density of less than 30 dtex and especially less than 25 dtex.

However, monofilaments composed of polypropylene only have the disadvantage of severe dusting in the weaving operation as a consequence of the low abrasion resistance of pure polypropylene, although other thermoplastics are known to have an abrasion problem too. For instance, EP-A2 0 784 107 mentions melt-spun polyamide, polyester and polypropylene monofils and shows that abrasion-resistant filaments are obtained with 70–99% by weight of fibre-forming polymer and 1–30% by weight of a maleic anhydride modified polyethylene-polypropylene rubber and further additives. However, the examples are limited to nylon 6 and polyethylene terephthalate and to a copolyamide of PA66 and PA6 as fibre-forming polymer. Spinning speeds are not reported. The relatively thick monofilaments exemplified are useful for papermachine wire fabrics and lawn mower wires. The production of relatively fine polypropylene monofilaments is not disclosed.

EP-A-1059370 discloses a method for the production of polypropylene multifilaments for textile purposes. The starting material used is a metallocene-catalysed isotactic polypropylene having a melt flow index of less than 25 g per 10 minutes in order that the desired shrinkage properties may be achieved. Low-shrinkage filaments are preferably produced using polypropylene chips having a high MFI value. The yarns produced are only described in general terms. Monofilaments are not described at all.

EP-A-0028844 describes a textile multifil polypropylene filament yarn. The starting polymer is a polypropylene having a melt flow index between about 20 and 60. The problem of abrasion encountered in the processing of fine monofilaments was evidently not observed under the reported spinning and stretching conditions and in the course of the further processing.

SUMMARY OF THE INVENTION

It is an object of the present invention to provide an economical process for producing fine abrasion-resistant monofilaments composed of polypropylene. It is a further object of the present invention to produce polypropylene fine monofilaments having improved resistance to abrasion in weaving.

It is yet a further object of the present invention to provide the use of a fine monofilament having good abrasion resistance for producing industrial fabrics.

These objects are achieved according to the invention when a compound consisting of 80 to 99.9% by weight of chips and 20 to 0.1% by weight of an additive is added to the extruder, the melt is spun at a speed of at least 1200 m/min, the fibre is cooled in an air bath at room temperature, supplementarily stretched at a temperature of 110 to 150° C. to a linear density of 5–20 dtex (0.027 mm–0.053 mm) and wound up. It is essential here that the additive has been thoroughly dispersed in the polypropylene and that no difference is observable in the resulting monofilament.

DETAILED DESCRIPTION OF PREFERRED EMBODIMENTS OF THE INVENTION

Figure 1:
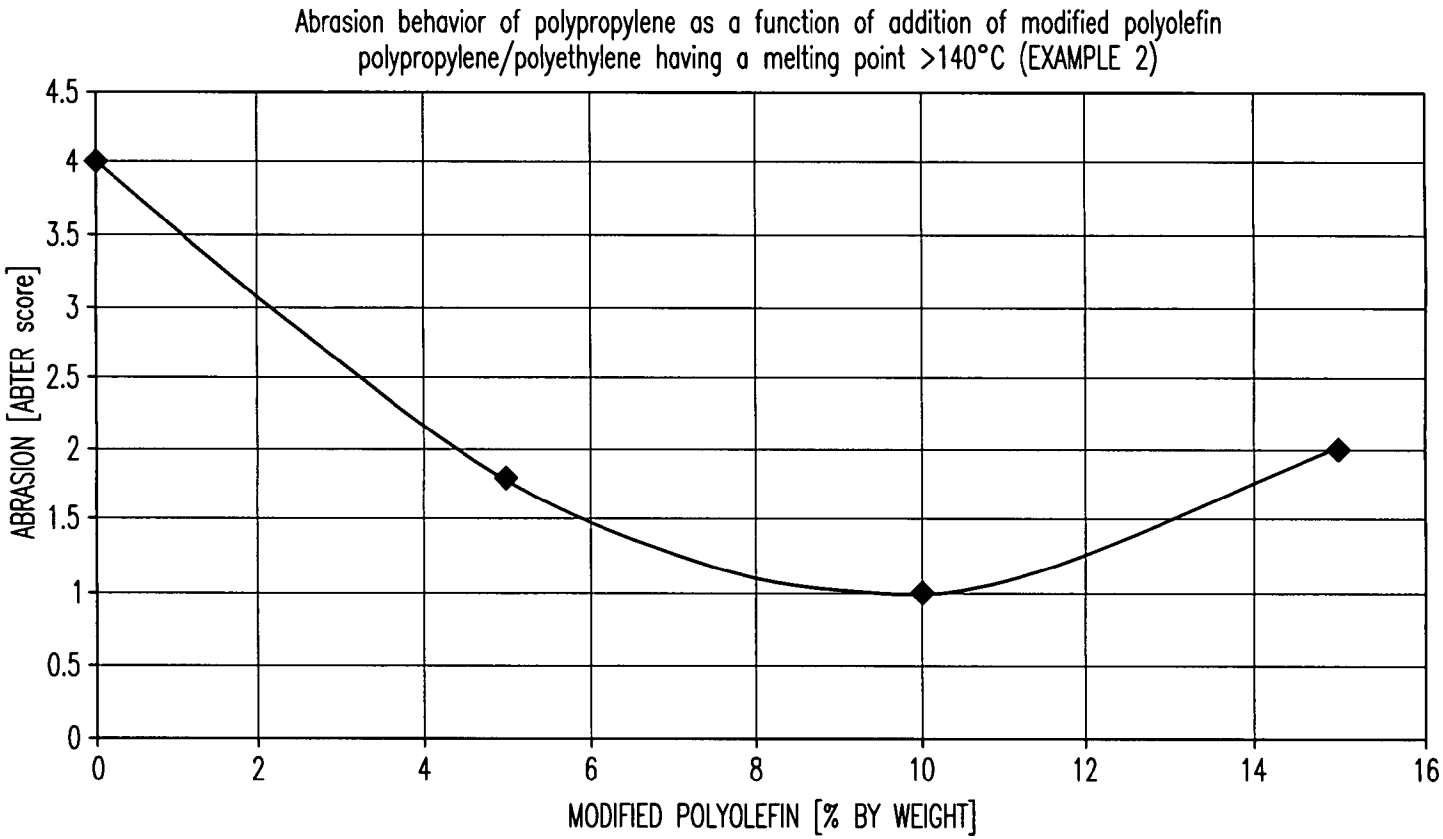
FIG. 1 shows the abrasion behavior as a function of the addition of an additive as in Example 2.

This is the first time that it has been possible to produce fine polypropylene monofilaments using a spinning speed of 1200 m/min. It has been determined to be advantageous to use additives selected from modified polyolefins and aliphatic diesters.

Particularly advantageous additives are modified polyolefins used in an amount of 4.5 to 15% by weight, especially 6 to 13% by weight and preferably 8 to 12% by weight of polypropylene/polyethylene having a melting point >140° C. A melting point of less than 140° C. is inconvenient to meter. This is because at temperatures below 140° C. the chips stick together in the extruder. Using less than 4.5% by weight and more than 15% by weight of polypropylene/polyethylene makes for a monofilament having an unsatisfactory abrasion resistance. This variant surprisingly requires no further additives to achieve outstanding abrasion resistance.

In a further variant, the additive used is advantageously 3–10% by weight, especially 3 to 7% by weight and preferably 3 to 6% by weight of an impact modifier. Useful impact modifiers do not soften at up to 100° C. and are constructed of linear styrene-ethylene/butylene-styrene block copolymers or alloys of linear styrene-ethylene/butylene-styrene block copolymer//styrene-ethylene/butylene biblock.

In a further variant, the additive used is advantageously 0.1–0.2% by weight of a plasticizer. Diisononyl adipate is a most suitable plasticizer.

In a further variant, the additive used is advantageously 0.05–1.0% by weight and especially 0.3 to 1.0% by weight of a lubricant. Useful lubricants are particularly metal salts of carboxylic acids, linear or branched hydrocarbons, fluoroelastomers, polydimethyl-siloxanes.

In a further variant, it is advantageous to use fillers as additive. Particularly useful fillers are 0.01–0.1% by weight of Aerosils and 0.1–1.0% by weight of calcium carbonate.

In a further variant, the additive is a compounded combination of 2–10% by weight of an impact modifier, 0.0.1–0.2% by weight of plasticizer, 0.01–0.1% by weight of Aerosil or 0.1–1.0% by weight of calcium carbonate as fillers, 0.05–1.0% by weight of lubricants and 0.1–0.5% by weight of heat stabilizers. Useful heat stabilizers include sterically hindered phenols, phosphites and phosphonites.

The main polymer contemplated for the monofilaments according to the invention is a polypropylene having a melt flow index $(MFI)_{230°\ C./2.16\ kg}$ of 2–16 g/10 min and a linear density of 5–20 dtex (0.027 mm–0.053 mm). A melt flow index of less than 2 g/10 min has the disadvantage that the melt-spinning operation requires excessively high temperatures, which leads to destruction of the polymer. A melt flow index of more than 16 g/10 min has the disadvantage that the resulting abrasion resistance is inadequate. An abrasion resistance score ≦2 is achieved by a monofilament which is easily weavable into a textile fabric and produces a surprising cleanness.

The monofilament according to the invention has a tenacity of at least 47 cN/tex and an elongation at break of less than 45%.

The monofilament according to the invention has a mechanical constant (constante méchanique) of at least 285 cN/tex.

The invention will now be more particularly described by way of example.

EXAMPLE 1

Polymer

The fibre-forming monofilament used was in all runs a polypropylene having a melt flow index $(MFI)_{230°\ C./2.16\ kg}$ of 12.0 g/10 min. For each run, 5 kg of polypropylene chips are blended using tinplate cans and a tumble mixer. Three different blending methods were used, depending on the additive. The individual methods are described in the examples. The blend of chips and additive is directly introduced into the extruder and melted.

Spinning Conditions

Extruder Diameter 38 mm:

- Maximum p=100 bar
- Throughput: 1–10 kg/h
- 6 heatable zones

Spin pack: Diphyl-heated; 1 spinning position

Spin pump: 3–27 rpm

Spinnerets: diameter outer/inner 85/70 mm

Quench chimney: 450–1100 $m^3$/h; 1=1.3 m

Extruder Temperatures for Zones 1 to 5:

180/230/250/250/265/275° C.

Pack+spinnerets: 275/275° C.

Throughput: 1.65 kg/h

Quench air: 700 $m^3$/h

Melt temperature: =280° C.

Spinning take-off speed: 1200 m/min

Stretching Conditions

Stretching is carried out using a laboratory stretching range equipped with two stretching units each made up of a godet (Ø=10 cm) and a separating roller.

The monofilaments undergoing a stretching operation pass through the following elements:

- Yarn brake
- Stretching unit V1, equipped with an additional feed or rubber roll. No snubbing pins.
- Hotplate 20 cm in length and positioned 20 cm away from the stretching unit
- Stretching unit V2
- Traveller ring spindle The variants are stretched using a stretch ratio of 3.6:1 and a hotplate (20 cm) at 130° C. The take-off speed of stretching unit V2 is 514 m/min.

EXAMPLE 2

Runs 2–4

In the case of the modified polyolefins, the chips blend, consisting of polypropylene and modified polyolefin, PP/PE melting point >140° C., is mixed for one hour.

EXAMPLE 3

Runs 5–7

In the case of the modified polyolefins, the chips blend, consisting of polypropylene and impact modifier, is mixed for one hour. It is advantageous to add an antistat, such as 0.1% of Atmer 110 (trade mark of Uniqema) in the case of these blends.

EXAMPLE 4

Runs 8 and 9

The plasticizer is added to the polypropylene chips and mixed in for two hours.

EXAMPLE 5

Runs 10–12

In the case of the pulverulent additives such as fillers, lubricants, heat stabilizers, etc., the chips are first tumbled for half an hour with a coupling agent such as Basilon M100 (trade mark of Bayer AG) before the remaining additives are added and mixed in for a further one and half hours. This series of runs includes the incorporation of calcium carbonate into polypropylene similarly to the above description.

EXAMPLE 6

Runs 13–16

In this example, a lubricant is added to the polymer in various amounts.

Same preparation as in Example 5.

EXAMPLE 7

Runs 17–19

In the case of the additives in the form of a combination of different compounds, run 17 contains two different lubricants (0.2 and 0.05%) and Aerosil at 0.05%. Runs 18+19 are based on three additives.

0.35% of heat stabilizer, 0.3% of calcium carbonate and 0.15% of lubricant 4

0.5% of heat stabilizer, 0.2% of lubricant 4 and 0.01% of Aerosil

Same preparation as in example 5.

The results are summarized in Table 1.

Methods of Measurement melt flow index by ASTM D1238 abrasion test by ABTER

This test is a simple simulation of the weaving process on a test apparatus without weft insertion. The monofilaments are passed at a constant speed through the most important elements of a weaving machine such as reed and healds while these are making their appropriate movements. The monofilament speed is 9 m/h and the reed performs 525 double strokes per minute.

The evaluation of the abrasion behaviour using the ABTER tester is carried out as follows.

the abrasion behaviour is tested on all monofils for a period of 16 hours

TABLE 1

| Run number | ADDITIVE | ABTER score | dtex | Tenacity [cN/tex] | Breaking extension [%] | Mechanical constant [cN/tex] | Specific work to break [cN · cm/dtex] |
|---|---|---|---|---|---|---|---|
| 1 | 0 | 4 | 9.9 | 51.4 | 32.6 | 293.47 | 61.4 |
| 2 | 5% | 1.8 | 10.4 | 53.5 | 31.7 | 301.22 | 62.69 |
| 3 | 10% | 1.0 | 10.4 | 54.1 | 30.3 | 297.80 | 59.57 |
| 4 | 15% | 2.0 | 10.8 | 53.3 | 30.6 | 294.84 | 59.20 |
| 5 | 3% | 2.0 | 10.8 | 47.7 | 41.1 | 305.80 | 76.52 |
| 6 | 4.5% | 0.8 | 10.4 | 48.9 | 42.9 | 320.29 | 82.50 |
| 7 | 6.0% | 0.8 | 10.4 | 48.4 | 41.1 | 308.78 | 77.07 |
| 8 | 0.10% | 1.66 | 10.8 | 48.8 | 34.5 | 286.63 | 62.92 |
| 9 | 0.15% | | | | | | |
| 10 | 0.4% | 2.5 | 10.4 | 49.5 | 29.3 | 267.94 | 51.46 |
| 11 | 1.2% | 0.83 | 11.2 | 47.2 | 43.4 | 310.95 | 81.67 |
| 12 | 2.0% | | | | | | |
| 13 | 0.2% | 3.66 | 10.1 | 50.5 | 31.8 | 284.78 | 58.53 |
| 14 | 0.5% | 1.33 | 10.4 | 51.2 | 34.9 | 302.47 | 67.17 |
| 15 | 0.8% | 0.83 | 10.4 | 51.4 | 32.1 | 291.22 | 60.81 |
| 16 | 1.0% | 1.16 | 10.4 | 51.9 | 30.3 | 285.69 | 67.36 |
| 17 | 0.2/0.05/0.05% | 0.83 | 10.4 | 51.6 | 34.1 | 301.32 | 65.65 |
| 18 | 0.35/0.3/0.15% | 0.83 | 10.8 | 49.3 | 37.1 | 300.29 | 69.53 |
| 19 | 0.50/0.2/0.01% | 1.16 | 10.8 | 51.5 | 40.7 | 328.55 | 78.97 |

Runs 2–4 Polypropylene MFI 12.0 g/min with PP/PE, m.p. >140° C. as additive;

Runs 5–7 Polypropylene MFI 12.0 g/min with an impact modifier

Runs 8–9 Polypropylene MFI 12.0 g/min with a plasticizer additive

Runs 10–12 Polypropylene MFI 12.0 g/min with a filler additive

Runs 13–16 Polypropylene MFI 12.0 g/min with a lubricant additive

Runs 17–19 Polypropylene MFI 12.0 g/min with a compounded additive

The results are illustrated in graphs.

The results are illustrated in graphs.

FIG. 1 shows the curve from the addition of a modified polypropylene/polyethylene having a melting point of >140° C. as per Example 2. Without addition of an additive, the pure polypropylene achieves an abrasion test score of 4, which indicates unsatisfactory abrasion in the fabric. It is surprising that abrasion initially improves with increasing amounts being added, up to an addition of 10% by weight, and deteriorates again at higher amounts added.

Figure 2:
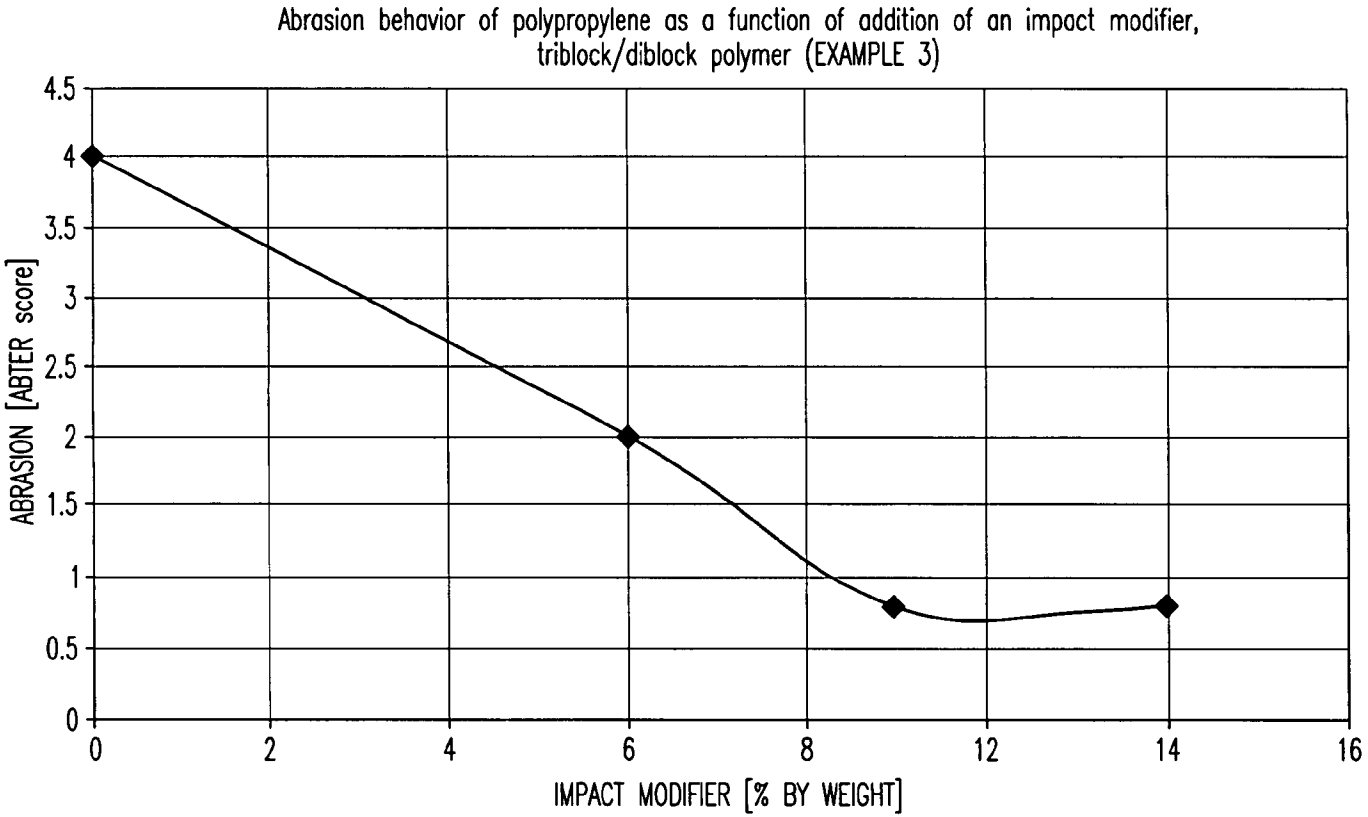
FIG. 2 shows the abrasion behavior as a function of the addition of an additive as in Example 3.

FIG. 2 shows the curve resulting from the addition of an impact modifier. As the amount of additive increases, abrasion initially decreases, reaching a minimum at 5% by weight. Larger quantities produce no further benefit.

Figure 3:
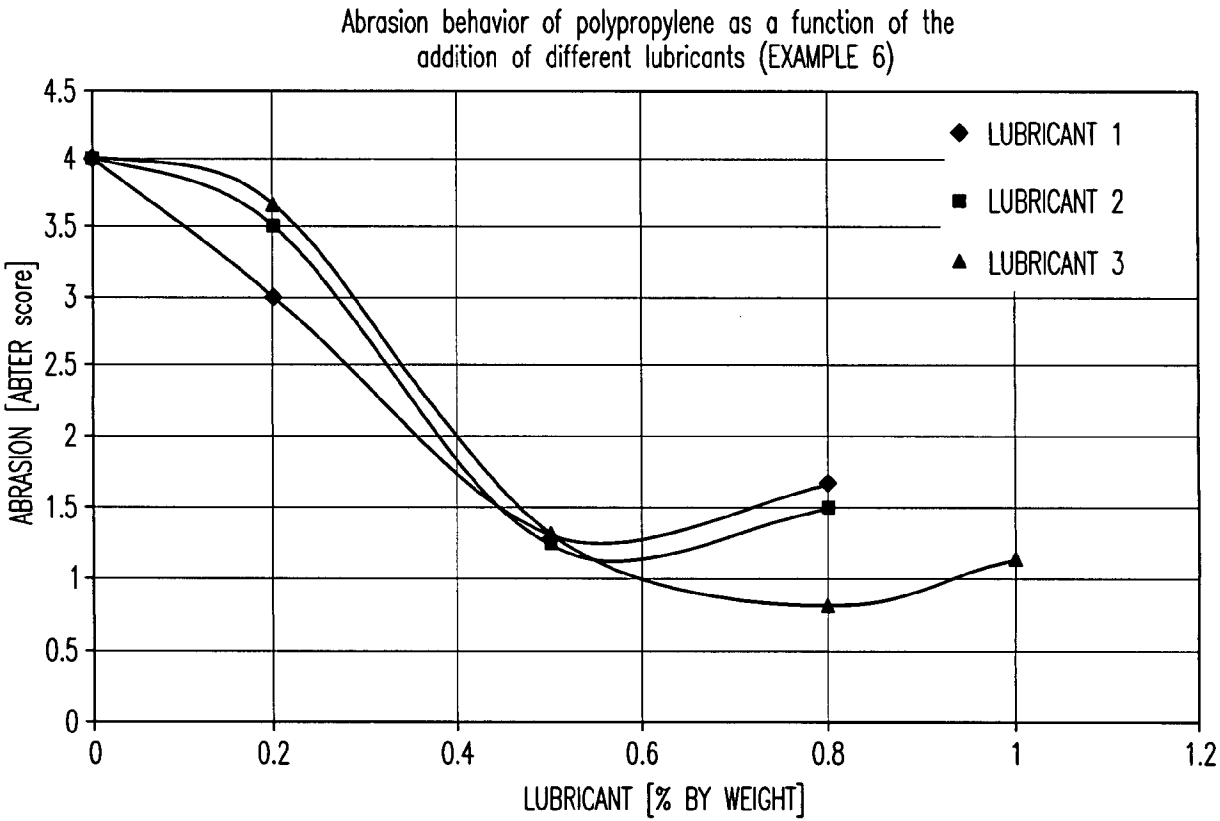
FIG. 3 shows the abrasion behavior as a function of the addition of an additive as in Example 6.

FIG. 3 shows the curve resulting from the addition of different lubricants. Here, small amounts added initially achieve a marked improvement in the abrasion behaviour. Raising the amounts added yields no further improvement in abrasion behaviour.

the reeds are removed from the simulator and photographed the deposits on the reeds are visually rated by three people, who award scores on a scale from 0–1 (=no deposit, no abrasion) to 5 (=substantial deposit, substantial abrasion)

linear density determined in accordance with SN 197 012 and SN 197 015 and additionally DIN 53 830 tensile tests to DIN 53 815, DIN 53 834 and additionally BISFA the mechanical constant CM is calculated by the formula $$CM=\sqrt{D\cdot F}\,[cN/tex]$$

where D is the elongation at break in % and F is the tenacity in cN/tex.

The fine monofilaments according to the invention are useful for producing woven screen fabrics for filtration and screen printing without abrasion deposits.

The invention claimed is:

1. Monofilaments, comprising a polypropylene having a melt flow index $(MEI)_{230° C./2.16 kg}$ of 2–16 g/10 mm and having improved abrasion resistance, having a linear density of 5–20 dtex (0.027 mm–0.053 mm), and having a tenacity of at least 47 cN/tex and an elongation at break of less than 45%.

2. Monofilaments, comprising a polypropylene having a melt flow index $(MFI)_{230° C./2.16 kg}$ of 2–16 g/10 min and having improved abrasion resistance, having a linear density of 5–20 dtex (0.027 mm–0.053 mm), and having a mechanical constant (constante méchanique) of at least 285 cN/tex.

3. Monofilaments, comprising a polypropylene having a melt flow index $(MEI)_{230° C./}$2.16 kg of 2–16 g/10 min and having improved abrasion resistance, having a linear density of 5–20 dtex (0.027 mm–0.053 mm), and having a specific work to break value of more than 61.5 cNcm/dtex.

4. A method for producing fabrics comprising weaving the monofilaments according to claim 1 into a woven fabric.

5. Industrial fabrics comprising the woven fabrics prepared according to claim 4.

6. The industrial fabric of claim 5 in the form of a filtration fabric.

7. A method for producing fabrics comprising weaving the monofilaments according to claim 2 into a woven fabric.

8. Industrial fabrics comprising the woven fabrics prepared according to claim 7.

9. The industrial fabric of claim 8 in the form of a filtration fabric.

10. A method for producing fabrics comprising weaving the monofilaments according to claim 3 into a woven fabric.

11. Industrial fabrics comprising the woven fabrics prepared according to claim 10.

12. The industrial fabric of claim 11 in the form of a filtration fabric.

* * * * *